US007591111B2

(12) United States Patent
Froeter et al.

(10) Patent No.: US 7,591,111 B2
(45) Date of Patent: Sep. 22, 2009

(54) INLET FLOW MULTIPLIER AND ROOF DRAIN UTILIZING SAME

(75) Inventors: Craig J. Froeter, Sterling, IL (US); Jeff Giordano, Moline, IL (US)

(73) Assignee: Froet Industries, LLC, Sterling, IL (US)

( * ) Notice: Subject to any disclaimer, the term of this patent is extended or adjusted under 35 U.S.C. 154(b) by 571 days.

(21) Appl. No.: 11/053,972

(22) Filed: Feb. 9, 2005

(65) Prior Publication Data

US 2005/0178073 A1 Aug. 18, 2005

Related U.S. Application Data

(60) Provisional application No. 60/544,176, filed on Feb. 12, 2004.

(51) Int. Cl.
*E04D 13/04* (2006.01)

(52) U.S. Cl. ..... 52/302.1; 284/42; 210/163

(58) Field of Classification Search ..... 52/302.1, 52/302.7; 4/650, 652, 679; 210/163; 285/42; 137/357

See application file for complete search history.

(56) References Cited

U.S. PATENT DOCUMENTS 1,342,918 A * 6/1920 Legg ..... 285/42
1,494,234 A * 5/1924 Gossett ..... 285/42
1,647,414 A * 11/1927 Moore ..... 285/47
1,761,257 A * 6/1930 Fleming ..... 210/166
2,666,493 A * 1/1954 Gordon ..... 210/166
2,711,127 A * 6/1955 O'Day ..... 454/292
3,811,644 A * 5/1974 Arnault ..... 248/56
4,437,687 A * 3/1984 Wilson ..... 285/42
4,799,713 A * 1/1989 Uglow ..... 285/42
5,234,582 A * 8/1993 Savoie ..... 210/163

(Continued)

FOREIGN PATENT DOCUMENTS

GB 2 347 451 A 9/2000

OTHER PUBLICATIONS

Olympic Manufacturing Group (OMG, Inc.); Internet; Olyfast Accessories; Olyflow Drain Systems; FlowControl, OverFlow, and QuickFlow; http://www.olyfast.com; Date Last Viewed Feb. 28, 2004; two pages.

*Primary Examiner*—Richard E Chilcot, Jr.
*Assistant Examiner*—Chi Q Nguyen
(74) *Attorney, Agent, or Firm*—Reinhart Boerner Van Deuren P.C.

(57) ABSTRACT

An inlet flow multiplier for a drain is provided. The multiplier includes a planar baffle having a mounting collar oriented perpendicular to the plane of the baffle. The collar has a pair of clamping flanges to allow it to be mounted to drains of varying diameter. The length of the baffle is substantially longer than the diameter of the drain to which it is mounted. In one embodiment, the length is approximately five times as long. The baffle is mounted so that it intersects the circumference of the drain. Optimally, the baffle bisects the drain opening. A bi-functional roof drain utilizing the inlet multiplier is also provided. Such a drain includes a primary drain and a backup drain pipe extending through and isolated from the primary drain. The planar baffle is attached via the mounting collar to the backup drain pipe to position the planar baffle above the top opening.

16 Claims, 5 Drawing Sheets

U.S. PATENT DOCUMENTS 5,526,613 A * 6/1996 Simeone, Jr. ..... 52/12
5,724,777 A * 3/1998 Hubbard ..... 52/198
5,749,190 A * 5/1998 Williams ..... 52/302.1
5,966,884 A * 10/1999 Uglow ..... 52/302.1
7,010,889 B1 * 3/2006 Renfro ..... 52/219

* cited by examiner

INLET FLOW MULTIPLIER AND ROOF DRAIN UTILIZING SAME

CROSS-REFERENCE TO RELATED PATENT APPLICATION

This patent application claims the benefit of U.S. Provisional Patent Application No. 60/544,176, filed Feb. 12, 2004, the entire teachings and disclosure of which are hereby incorporated in their entireties by reference thereto.

FIELD OF THE INVENTION

The present invention relates generally to water drainage systems, and more particularly to roof water drainage systems and drains used for flat roofs.

BACKGROUND OF THE INVENTION

Commercial and industrial buildings are typically constructed with flat or near flat roofs. Because these buildings do not have much if any of a pitch to the roof the collection of water on the roof surface resulting from rain and melting snow could present a serious structural load that could result in collapse of the roofs structure. To avoid this possibility most commercial and industrial building standards require that roofs of this type include drains positioned at locations that ensure that at least the majority of water accumulation may be removed from the roof through a drainage plumbing system.

Typical roof drains are installed on flat roofs by cutting a hole through the roof deck and installing a drain therethrough. The drain typically connects with drainage plumbing that carries the water away. The drain structure typically includes some form of flashing or collar that, through the application of sealant or other roof material prevents leakage at the site of the drain installation. These typical drain structures also include some form of drain ring and under deck clamping ring or structure that holds the drain in place and prevents its inadvertent removal or dislodgement from its installed position. The opening of the roof drain is typically covered by some form of grating or strainer structure to prevent the ingestion of large objects into the drain plumbing system. In most roof drain structures this strainer or grate takes the form of a hemispherical strainer to prevent or minimize the occurrence of obstruction of the roof drain through the accumulation of leaves and other debris that may accumulate on the roof.

Unfortunately, despite the inclusion of a strainer or other grating structure, many roof drains still become plugged or otherwise obstructed to the point that inhibits their ability to remove the accumulated water from the roof of the building. These obstructions can occur as a result of the collection of debris around or over the grate or strainer structure. Additionally, obstructions may also result in the roof drain system during winter months as a result of icing near the roof level of the open areas of the strainer. In addition to the obvious problems resulting from complete obstruction of the roof drains, minor obstructions that merely result in the reduction in the rate of water removal from the roof may also result in undo stress on the roof structure that may endanger its integrity. Additionally, even unobstructed roof drains may not be able to remove water at a rate to prevent its undue accumulation during periods of heavy storms and intense rainfall.

In recognition of the limitations of a single roof drain system, many building codes and many more contractors are installing backup roof drains connected to separate drainage system to ensure that the load carrying capacity of a roof structure is not exceeded if the primary roof drain system fails to remove the water accumulation at a sufficient rate. These backup roof drains are typically constructed in the same manner as the primary roof drains, but include a structure that prohibits the drainage of water through the backup drainage system until the level of the water reaches a predetermined depth. That is, the entry ports or slots on the backup roof drains are positioned at a height above the roof surface. This height is preferably chosen based upon the roof construction such that the weight of the water at that given height is well within the load carrying of the roof structure. The separate drainage system ensures that failure of the primary roof drain system due to an obstruction in the drainage system downstream from the roof drains will not affect the ability of the backup roof drain system to remove the water that accumulates above a given depth.

While the usage of a primary and backup roof drain system greatly enhances the safety of the roof construction, such also greatly increases the cost of the roof construction. This significant cost increase is a result of the requirement for essential double the number of roof drains that must be installed on the roof. Since typical primary and backup roof drains are of the same construction differing only in the strainer or inlet structure, the cost for such roof drains is essentially double. In addition to the increased cost necessitated by the purchase of twice as many roof drains, each roof drain requires a separate deck penetration or hole to be cut in the roof structure. This essentially doubles the labor cost associated with such a system as twice as many roof penetrations must be cut. Further, depending on the number of primary and backup roof drains that are installed, the overall structural strength of the roof may be weakened due to the large number of deck penetrations that are cut to accommodate both the primary and backup roof drains.

While these factors may be considered in the design of a new construction, and therefore compensated, the cost and structural impact to existing buildings that may wish to or are required to install such a backup roof drain system can be prohibitive. That is, on an existing building the roof's structure and strength are already set, and any impact thereto resulting from the installation of the backup roof drains is not easily compensated. Additionally, the roof surface itself may already be occupied by other equipment that limits the ability to properly position additional backup roof drains to maximize their effectiveness. Further, additional roof penetrations by other system within a building may also limit the ability to install the backup drains at appropriate locations due to clearance requirements dictated by the roof penetrations of the other systems. As a result, the retrofit of an existing building to install the backup roof drain system often is not only expensive but also quite problematic if it can be installed at all.

These problems are further exacerbated in areas that receive an abundant amount of precipitation. In such areas, the often rapid deposit of precipitation on the large area of a building's roof may not be drained away fast enough to keep up with a deluge. This situation often occurs even though the calculated flow from the numerous roof drains should be able to handle the amount of precipitation. The source of this problem relates to the Coriolis forces caused by the Earth's rotation. These forces result in a swirling vortex being formed around the drains, such as is illustrated in FIG. 1. As the flow enters the drain, the vortex is stretched and intensified. As a result, the convergence results in the buildup of a large static head over the drain (see FIG. 2), and ultimately limits the capacity of the drain far below its rated flow capacity.

Since many building specifications use the rated flow capacity of the drain pipe to dictate the number and size of the drains needed for a given roof, the existence of these forces and the limiting effect that they have on the water removal capacity of these roof drains can result in a dangerous buildup of water on the roof, especially during periods of heavy precipitation.

There exists, therefore, a need in the art for a means to reduce or eliminate the flow reducing effect of the Coriolis forces on drains, and on roof drains in particular.

BRIEF SUMMARY OF THE INVENTION

In view of the above, it is a general aim of the invention to provide a new and improved roof drain for flat roofs. More particularly, it is a general aim of the present invention to provide a new and improved roof drain that reduces or eliminates the flow reducing effect of the Coriolis forces. Additionally, it is a general aim of the present invention to provide such a roof drain for initial installations on new constructions, and for retrofitting existing structures to include the Coriolis force negative flow effect reducing capability.

In one embodiment of the present invention, an inlet flow multiplier (IFM) is included at the inlet of the drain. In this embodiment, this IFM is in the form of a single baffle extending beyond the periphery of the drain inlet, intersecting the opening. Preferably, the IFM dissects the opening of the drain. While the length of the IFM may vary, preferred embodiments of the present invention extend substantially beyond the outer periphery of the drain opening. The length of an exemplary embodiment for use on a 2 inch drain is 10 inches, on a 4 inch drain is 20 inches, and on a 6 inch drain is 30 inches. However, it should be noted that other length IFMs could be used.

Other aims, advantages, and features of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention.

DETAILED DESCRIPTION OF THE INVENTION

Figure 1:
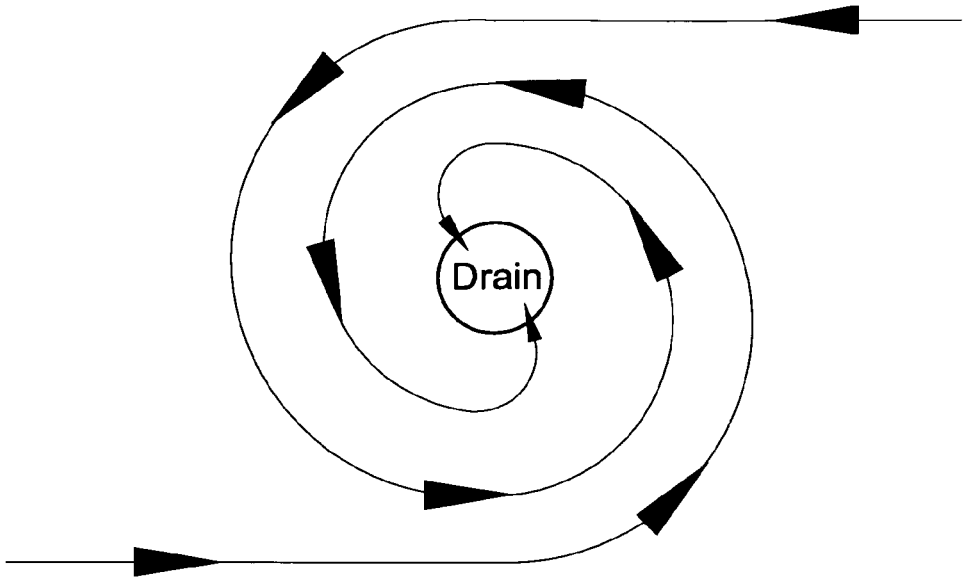
FIG. 1 is a simplified water flow diagram illustrating the swirling effect of water flowing into a drain due to the Coriolis forces.
Figure 2:
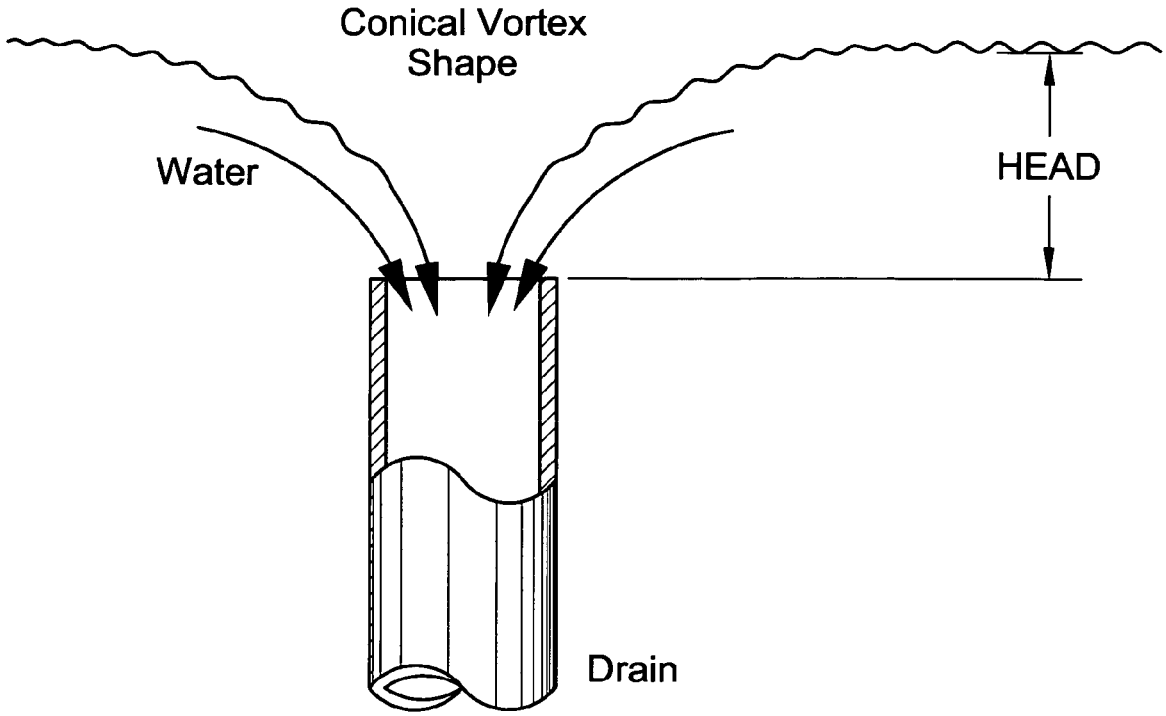
FIG. 2 is a simplified side view of the conical vortex shape and resulting head buildup of the flow of FIG. 1.
Figure 3:
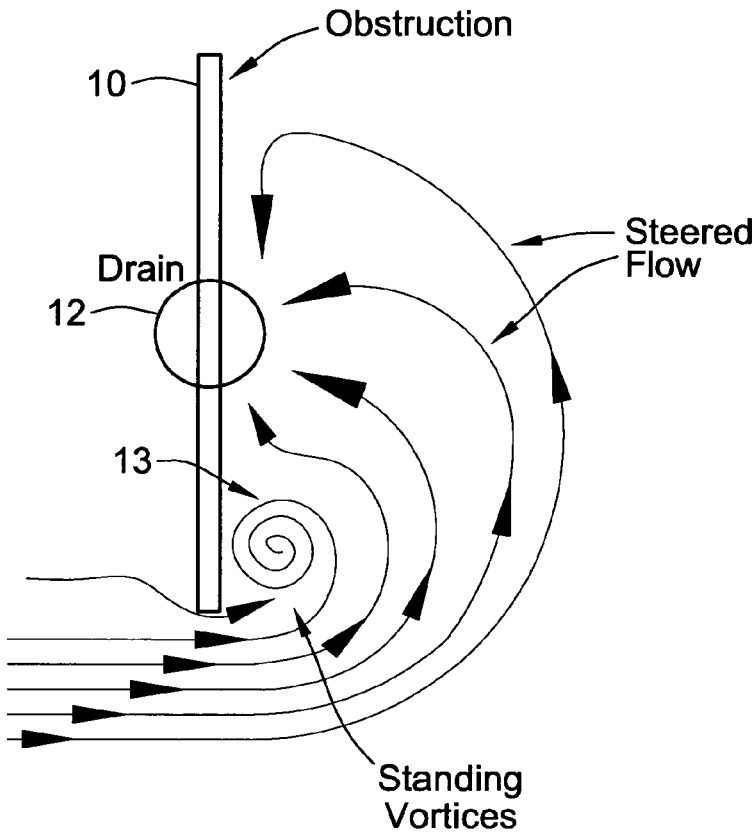
FIG. 3 is a simplified water flow diagram illustrating the water flow into a drain that includes an embodiment of the IFM of the present invention.

The inlet flow multiplier (IFM) 10 illustrated in FIG. 3 increases the flow capacity of any arbitrary inlet configuration by perturbing the rotational swirl pattern entering the drain caused by the Coriolis forces discussed above. By perturbing the swirling vortex of a normal drain (see FIG. 1) with the IFM 10 of the present invention, the flow potential of the drain, i.e., the actual flow into a drain in a real world installation, greatly increases.

Figure 4:
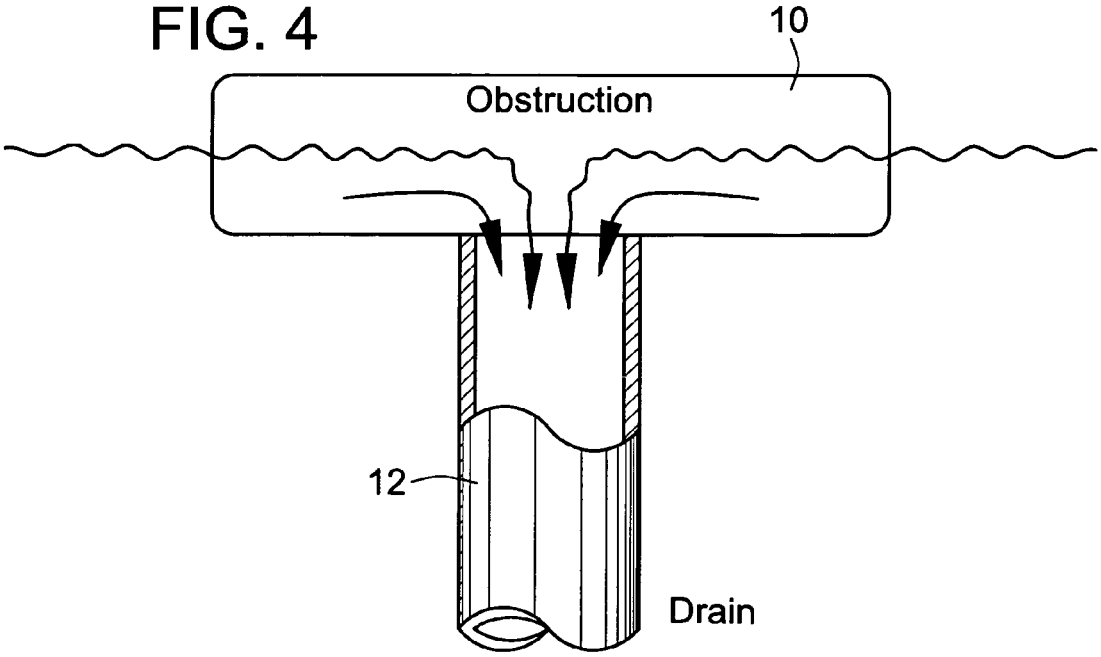
FIG. 4 is a simplified side view of the water flow into a drain including an embodiment of the IFM of the present invention.
Figure 6:
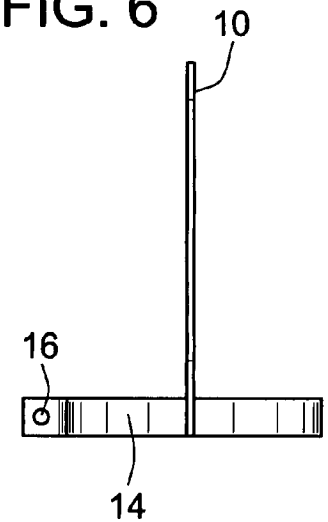
FIG. 6 is an end view illustration of the IFM of FIG. 5.
Figure 5:
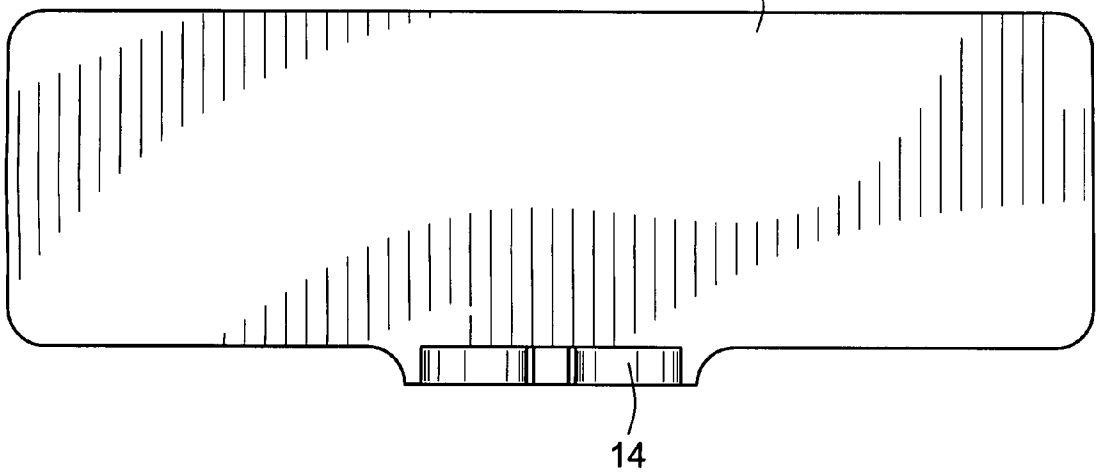
FIG. 5 is a side view illustration of an alternate embodiment of the IFM of the present invention.
Figure 7:
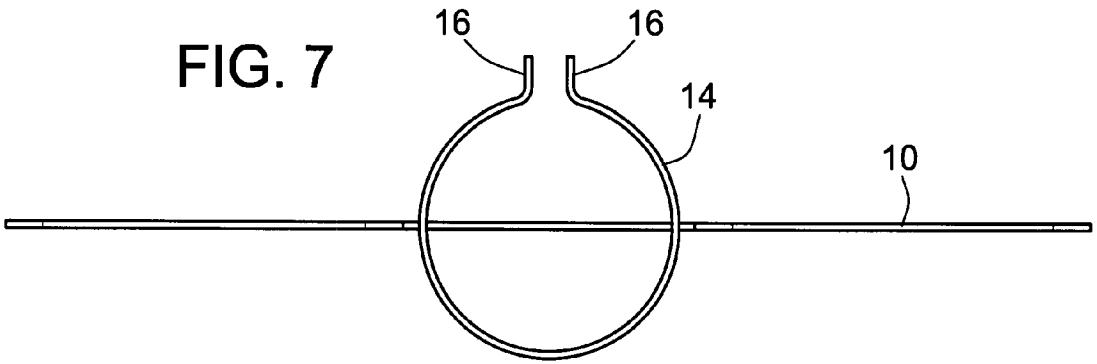
FIG. 7 is a top view illustration of the IFM of FIG. 5.
Figure 8:
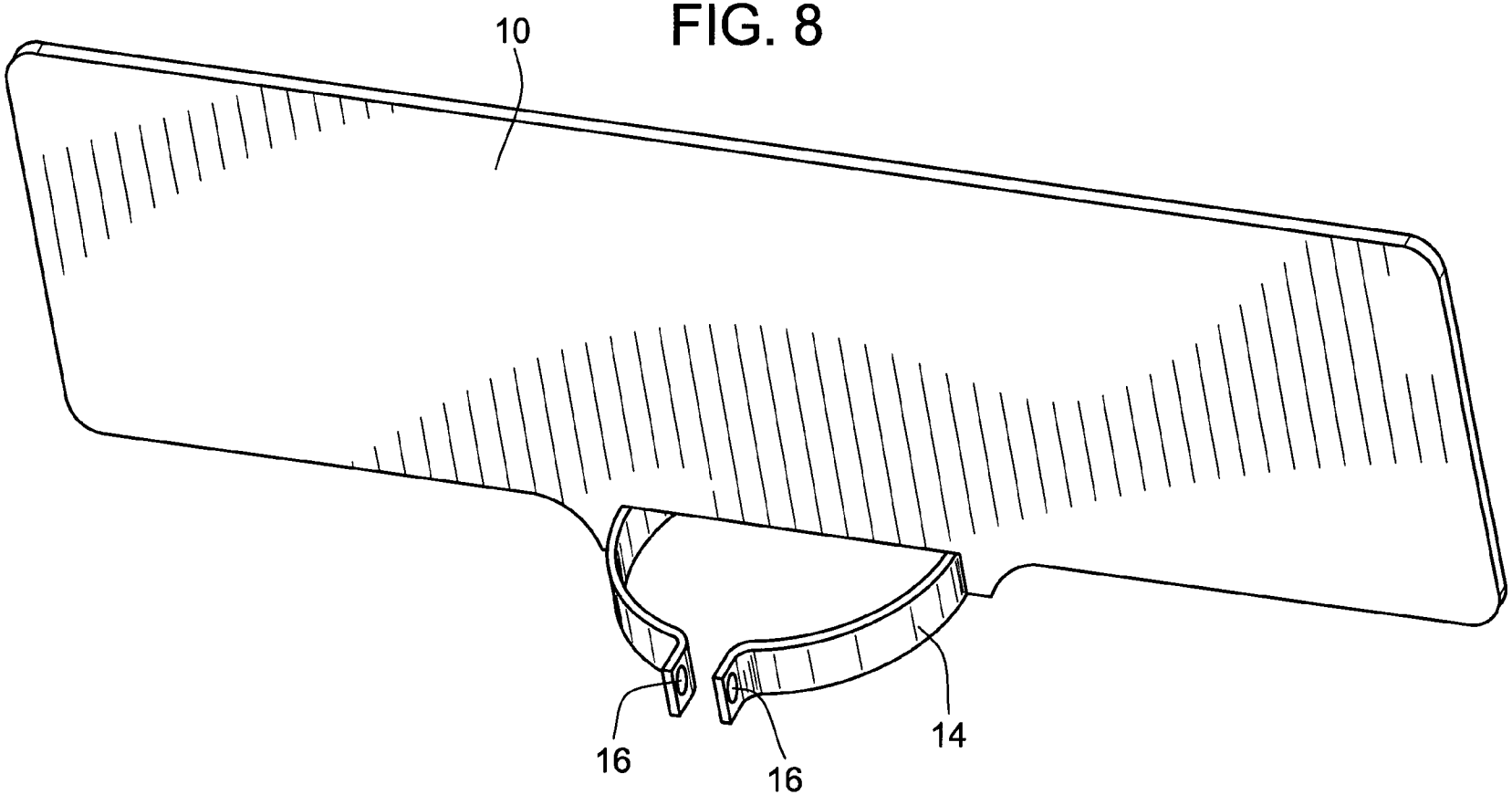
FIG. 8 is a perspective view illustration of the IFM of FIG. 5.

As illustrated in FIGS. 3 and 4 the IFM 10 is placed over a pipe opening 12 such that it intersects the diameter of the pipe 12. Preferably, the positioning of the IFM 10 is such that it bisects the drain 12. As a result of the placement of the IFM 10, the vortices that would normally form due to the Coriolis forces are obstructed. Instead, the water flow is steered to the drain opening 12. Standing vortices 13 may be created on the downstream edges of the IFM 10 as the flow impinges on the obstruction. Flow trapped in these small vortices is then directed to the drain opening which is acting as a vortex finder. The remainder of the surface area of the IFM 10 builds a thick boundary layer that, in conjunction with high transverse pressure gradients, steers the remaining flow into the drain. The effect of which is to increase the drains flow efficiency many times over.

Indeed, flow test results show that a standard roof drain may only accommodate 100 gallons per minute due to the vortex formed by the Coriolis forces. This 100 gallons per minute flow rate resulted in a seven inch head being established on the roof surface with a given deposition rate of precipitation on the roof. However, when the IFM of the present invention was utilized with the same drain, under the same conditions, the drain accommodated 400 gallons per minute with a four and three-quarter inch head. The flow rate dropped to 300 gallons per minute with a three and one-half inch head, and was measured at 200 gallons per minute with a three inch head. As these dramatic results illustrate, the IFM of the present invention significantly reduces the head and increases the flow rate of the drain by reducing or eliminating the typical vortex formed by the Coriolis forces. Such flow rate increases and reduction in head is significant for building safety, particularly in areas of the world that receive copious amounts of precipitation during a relatively short period of time.

In one embodiment of the present invention, the IFM 10 is configured to allow retrofitting of currently installed drain systems via a drain input collar 14 as illustrated in FIGS. 5-8. This collar 14 preferably includes clamping flanges 16 to allow a user to securely fasten the IFM to the drain opening. In this embodiment, the clamping of the IFM on the drain opening is accomplished by affixing the collar 14 around the outer periphery of the drain inlet. For installations that do not expose the outer diameter of the drain, other attachment mechanisms may be employed, including a sleeve that is dimensioned to be accommodated within an inner diameter of the drain inlet.

Figure 9:
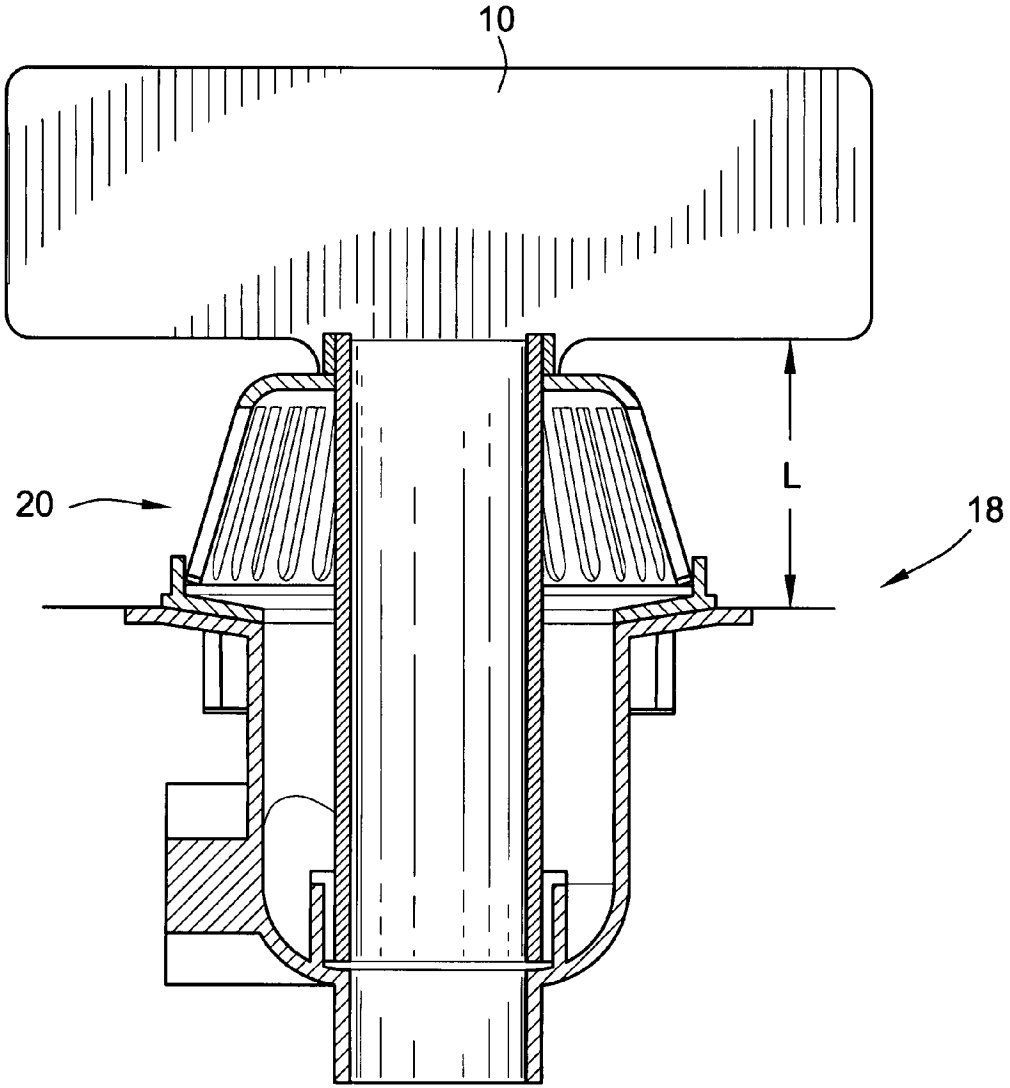
FIG. 9 is a partial cut-away side view illustration of a bi-functional roof drain incorporating an embodiment of the IFM of the present invention.

As illustrated in FIG. 9, a bi-functional roof drain 18 including an IFM 10 is illustrated. The construction and operation of the bi-functional roof drain 18 is as described in U.S. Pat. No. 6,594,966 entitled "Bi-Functional Roof Drain And Method Of Retrofitting A Roof Drainage System Therewith", the teachings and disclosure of which are hereby incorporated in their entireties herein by reference thereto. As illustrated in this FIG. 9, the IFM 10 is positioned to disrupt the vortex formed by the Coriolis forces once the standing water on the roof has reached the backup drain level L. In this way, normal drainage operation occurs through the main drain inlet 20. However, once the rate of precipitation exceeds the drain capabilities of the standard roof drains and the level of water on the roof rises to the backup drain level, or if the primary drains are plugged resulting in the same condition, the enhanced flow rate through the backup drain system facilitated by the inclusion of the IFM 10 will ensure that a safe condition will be maintained on the roof of the structure.

Alternatively, the IFM 10 may be extended downward to the level of the roof line so as to enhance the flow rate of the primary drainage system as well. However, such extension of the IFM 10 is not required with the bi-functional roof drain of the '966 patent based on the construction thereof.

All of the references cited herein, including patents, patent applications, and publications, are hereby incorporated in their entireties by reference.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An inlet flow multiplier for a drain, comprising:

a planar baffle having a mounting collar affixed thereto, the mounting collar oriented perpendicular to the plane of the baffle and having a pair of clamping flanges defining an opening in the collar therebetween;

wherein the mounting collar is affixed to the planar baffle at a lower edge thereof such that the planar baffle extends above a top opening of the drain when mounted thereto by the mounting collar; and wherein the mounting collar is affixed to the planar baffle so that the edge of the planar baffle to which the mounting collar is affixed intersects the circumference of the mounting collar in at least two locations.

2. The inlet flow multiplier of claim 1, wherein the planar baffle includes a pair of collar mating extensions extending from the lower edge thereof and wherein the collar is affixed between the collar mating extensions.

3. The inlet flow multiplier of claim 2, wherein the collar is affixed between the collar mating extensions via welding.

4. The inlet flow multiplier of claim 1, wherein the collar has a diameter conformable to an outer diameter of the drain by adjusting the clamping flanges.

5. The inlet flow multiplier of claim 1, wherein the mounting collar is affixed to the planar baffle so that the planar baffle bisects the circumference of the mounting collar.

6. The inlet flow multiplier of claim 1, wherein the planar baffle has a length substantially longer than a diameter of the mounting collar.

7. The inlet flow multiplier of claim 6, wherein the length is approximately five times the diameter of the mounting collar.

8. The inlet flow multiplier of claim 1, wherein the planar baffle is generally rectangular.

9. A bi-functional roof drain, comprising:

a drain housing forming a drain manifold therein having an open top;

a primary drain outlet in communication with the drain manifold;

a backup drain pipe extending through and isolated from communication with the drain manifold, the backup drain pipe having a top opening positioned a vertical distance above the open top of the drain housing, the backup drain pipe further including a backup drain outlet; and a planar baffle having a mounting collar affixed thereto, the mounting collar oriented perpendicular to the plane of the baffle and having a pair of clamping flanges defining an opening in the collar therebetween; and wherein the planar baffle is attached via the mounting collar to the backup drain pipe positioning the planar baffle above the top opening thereof.

10. The bi-functional roof drain of claim 9, further comprising a strainer basket positioned over the open top, and wherein the planar baffle is positioned above the strainer basket.

11. The bi-functional roof drain of claim 9, wherein the planar baffle is mounted to the backup drain pipe so that the planar baffle intersects the circumference of the top opening.

12. The bi-functional roof drain of claim 11, wherein the planar baffle is mounted to the backup drain pipe so that the planar baffle bisects the circumference of the top opening.

13. The bi-functional roof drain of claim 9, wherein the planar baffle has a length substantially longer than a diameter of the top opening of the backup drainpipe.

14. The bi-functional roof drain of claim 13, wherein the length is approximately five times the diameter of the top opening of the backup drain pipe.

15. The bi-functional roof drain of claim 9, wherein the planar baffle is generally rectangular in shape.

16. An inlet flow multiplier, comprising a single rectangular baffle having a means for mounting the rectangular baffle in a vertical orientation above a drain inlet to bisect the drain inlet, the single rectangular baffle having a length that is substantially longer than a diameter of the drain inlet; wherein the means for mounting comprises a mounting collar oriented perpendicular to the plane of the baffle and having a pair of clamping flanges defining an opening in the collar therebetween.

* * * * *

UNITED STATES PATENT AND TRADEMARK OFFICE

CERTIFICATE OF CORRECTION

PATENT NO. : 7,591,111 B2
APPLICATION NO. : 11/053972
DATED : September 22, 2009
INVENTOR(S) : Froeter et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1162 days.

Signed and Sealed this

Twenty-first Day of September, 2010

David J. Kappos

David J. Kappos
*Director of the United States Patent and Trademark Office*